United States Patent [19]

Pobiegły et al.

[11] 4,305,813

[45] Dec. 15, 1981

[54] METHOD OF EXTRACTIVE PURIFICATION OF RESIDUES FROM CRUDE OIL REFINING AND HEAVY ENDS THEREOF

[75] Inventors: Stanisław Pobiegły; Roman Dulski; Lucjań Cichon; Hieronim Tworek; Maria Stachowicz; Jerzy Kowalik, all of Cracow, Poland

[73] Assignee: Biuro Projektow i Realizacji Inwestycji Rafinerii Nafty "BIPRONAFT", Cracow, Poland

[21] Appl. No.: 52,575

[22] Filed: Jun. 27, 1979

[30] Foreign Application Priority Data

Jul. 10, 1978 [PL] Poland ..... 208309
Mar. 29, 1979 [PL] Poland ..... 214622

[51] Int. Cl.[3] ..... C10G 21/16
[52] U.S. Cl. ..... 208/309; 208/181
[58] Field of Search ..... 208/309, 181

[56] References Cited

U.S. PATENT DOCUMENTS 2,213,798 9/1940 Anne ..... 208/309
3,364,138 1/1968 Campagne et al. ..... 208/309
4,069,141 1/1978 Lionetti et al. ..... 208/309

*Primary Examiner*—Delbert E. Gantz
*Assistant Examiner*—William Leader

[57] ABSTRACT

The subject of the invention is a method of extractive purification of products of crude oil processing, especially of residues, of heavy ends, extracts and used oils, from tars of asphaltenes and other compounds.

The process is conducted employing an extraction solvent and an additional substance having a limited miscibility with the extraction solvent. The substance constituting the additional solvent is appropriate for rapid obtaining of a distinct limit of phase separation.

5 Claims, 1 Drawing Figure

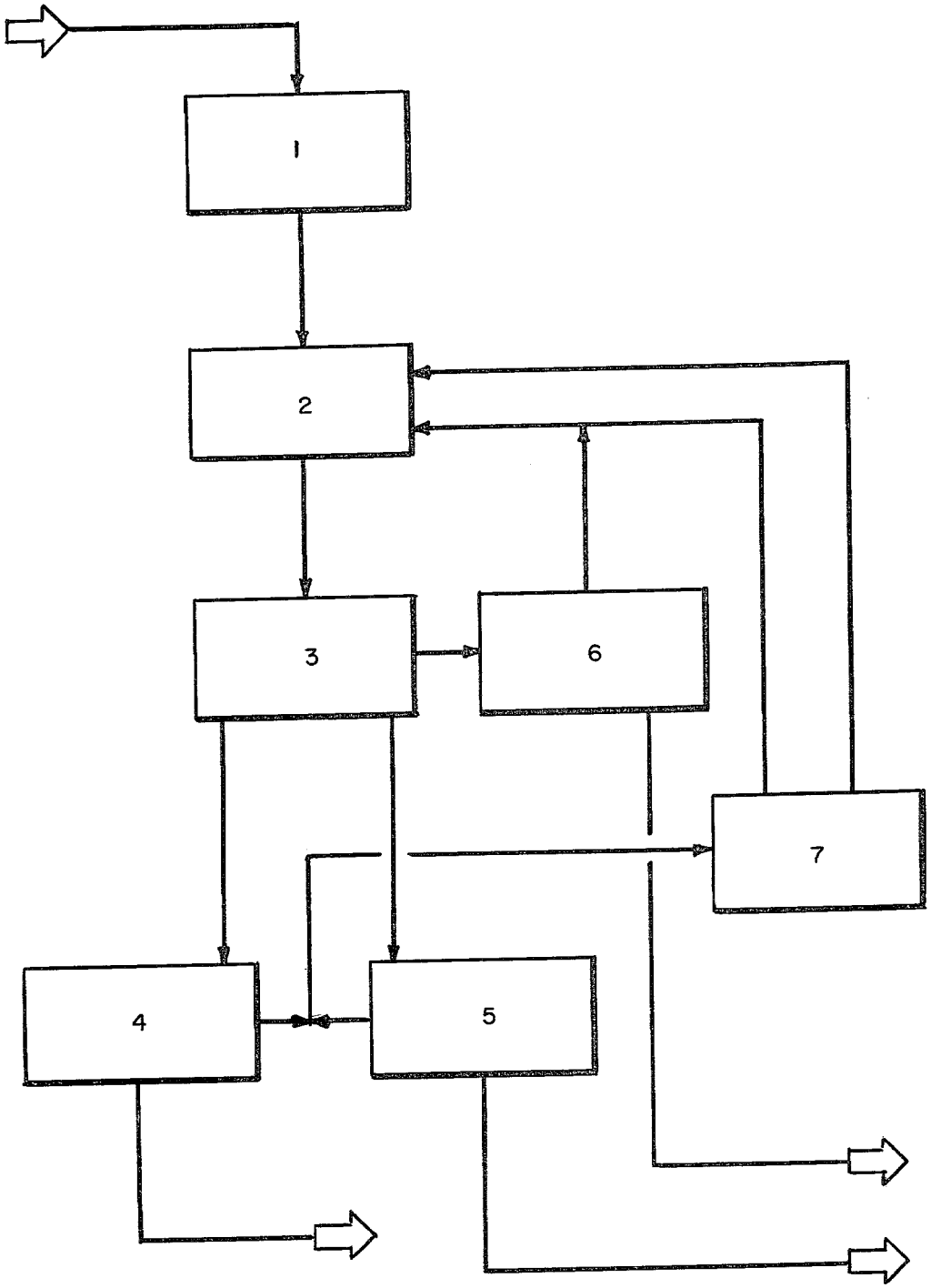
1
2
3
6
7
4
5

METHOD OF EXTRACTIVE PURIFICATION OF RESIDUES FROM CRUDE OIL REFINING AND HEAVY ENDS THEREOF

This invention relates to a method of extractive purification of products of crude oil refining, and especially of residues, heavy ends, extracts and used oils, of asphaltene tars and other compounds in order to obtain raw materials for production of high-quality petroleum-origin cokes, purification of used oils and similar products.

Known methods of extractive purification of residues from crude oil purification and heavy ends thereof consist in employing of hydrocarbon solvents, mainly paraffin solvents, propane or butane, precipitating the majority of useless substances, with the production of only two layers, that is raffinate and extract.

Apart from said known methods, there exist also elaborations taking into consideration the dissolving power and selectivity of solvents in relation to the undesired substances, which among others are asphalt-and-resin compounds with various molecular weights.

The conclusions from said elaborations prove that there exist extraction solvents having extraction properties much better than those of solvents employed today, but which are not used due to difficulties involved in the separation of the raffinate layer from the extract layer, which excludes the application thereof especially for industrial continuous processes.

A known method of introduction of extraction solvents of this type consists in employing auxiliary solvents of the type of "anti-solvents" influencing the dissolving power of an extraction solvent. Those related, however, to further extraction processes of the type producing raffinate+extract.

The objects of the invention are the acceleration of the separation of phases, providing of a method of extractive purification of residues from the crude oil processing and heavy ends thereof, and eliminating the impurities in the course of the purification process of used oils, i.e., the components useless for production of high-quality petroleum cokes during the processing of coke-forming aromatic compounds.

The invention consists substantially in the employment, for the extraction, of an extraction solvent in admixture with an additional substance with restricted miscibility with the extraction solvent, appropriate for rapid obtaining of distinct phase boundary formation.

The purification is conducted at pressures contained within the limits of 0.03–16 at. and at temperatures of 0°–200° C. As extraction solvents there are used: butyl alcohol and/or ketones, or a mixture of butyl alcohol with other alcohols and/or ketones.

The most advantageous anti-solvent with restricted miscibility with the extraction solvent, as found in course of tests, is water, water steam or a condensate thereof.

The most advantageous parameters for use in this purification are pressures of 1–6 at. and temperatures of 60°–150° C. As a result of employing the process according to the invention, three phases are formed in the separator: extract; raffinate; and the third phase of the anti-solvent.

The results of application of the method according to the invention are obtaining of products of high purity; maintenance of the advantageous purification properties of the solvent; as well as considerable reduction of the purification time, which causes an increase of the capacity of the plant.

An exemplary embodiment of the method according to the invention is shown in the accompanying drawing by way of a block diagram.

The raw material is supplied to the element 1 for preliminary treatment of the raw material, wherefrom it passes successively to the extraction element 2, and to the separation element 3. In the separation element 3, the separation of the mixture of the raw material diluted with solvents into three phases occurs, these phases being then supplied to the element 4 for recovery of the solvent mixture layer from the extract; in element 5, recovery of the solvent mixture from the raffinate is effected; and in element 6 purification of the anti-solvent is effected.

After separation of the solvents in elements 4 and 5, the streams of extract from the element 4 and of raffinate from the element 5 are taken off as final products or as intermediates for further processing.

The mixtures of solvents isolated in elements 4 and 5 are supplied to the element 7 for the separation of solvents, wherein is effected the separation of the extraction solvent and any accompanying anti-solvent.

The extraction solvent from the element 7 and the anti-solvent from the elements 6 and 7 are, as separate streams, supplied to the extraction element 2 forming thus a closed cycle of the solvent and anti-solvent, securing thus an economic management of the process.

The raw material is supplied to the element 1 for preparation of the raw material wherein a preliminary treatment thereof for further processing is performed. This treatment in most cases, consists in distillation. The distillate or otherwise treated stream of raw material is passed to the element 2 for extraction, wherein it is diluted and mixed with the extraction solvent and the anti-solvent.

As extraction solvent there is employed: butyl alcohol and/or ketones, or their mixtures with other alcohols.

The anti-solvent produces rapid phase separation. Such anti-solvent is most advantageously water, water steam, or the condensate thereof.

In the extraction element 2, at the pressure of 0.03–16 at. and temperature of 0°–250° C., there occurs the penetration of the raw material by the supplied solvent and anti-solvent.

The diluted and penetrated raw material passes into the separation element 3 wherein the separation into three phases follows:

brown-coloured top layer of raffinate consisting of asphaltene-free raw material diluted with the solvent mixture;

colourless or slightly opalescent bottom layer consisting of the anti-solvent and impurities;

black-coloured intermediate layer of extract consisting of asphaltenes, tars and other impurities.

The separate phases are led to the element 4 for recovery of the solvent mixture layer from the extract element 5 of recovery of the solvent mixture from the raffinate, and to the element 6 of purification of the auxiliary solvent from impurities, respectively.

In the element 4, there is an isolation of the solvent mixture from the extract, which is taken off for further processing in order to obtain asphaltenes, or for use as a component of heating oils. In the element 5, there is an isolation of the solvent mixture from the raffinate, which is taken off as a final product or for use in the production of petroleum.

EXAMPLE I

The method according to the invention was employed for treating a vacuum residue, containing 6.35% by weight of asphaltenes and 5.14% by weight of sulphur, at the processing temperature of 112° C. and pressure of 2.0 at., using 1-butanol as extraction solvent, and water as anti-solvent for the phase separation. In a time of several seconds, raffinate was obtained, which on being isolated from the solvent mixture contained 0.18% by weight of asphaltenes and 4.0% by weight of sulphur.

EXAMPLE II

The method according to the invention was employed for treating the vacuum residue as specified in Example I, using the same solvent and anti-solvent, under processing conditions of 1.0 at. and 93° C. In a time of several seconds, raffinate was obtained, which on being isolated from the solvent mixture contained 1.11% by weight of asphaltenes and 4.39% by weight of sulphur.

Realization of the process according to the described invention can be conducted—similarly as in Examples 1 and 2—also under boundary conditions, according to the boiling curve of butyl alcohol.

What is claimed is:

1. A method of extractive purification of asphaltene-containing residues from crude oil processing comprising the steps of:

(a) admixing the residues in an extraction element simultaneously with a solvent selected from the group consisting of butyl alcohol, ketones, a mixture of butyl alcohol with other alcohols and a mixture of butyl alcohol with ketones therefor and an anti-solvent selected from the group consisting of water, steam and steam condensate, (b) subjecting said admixture to a pressure of between 0.03 to 16 at. and a temperature of between 0° to 260° C., therby forming three distinct phases in a separation element, (c) separating the resulting phases from each other, and (d) recovering asphaltene-free charging stock, solvent and anti-solvent.

2. The method of claim 1 wherein step (b) is effected at a pressure of 1–6 at. and a temperature of 60°–150° C.

3. The method according to claim 1 wherein said phases consist of (i) a top layer of a raffinate comprising asphaltene-free raw material diluted with solvent, (ii) an intermediate layer of asphaltenes, tars and other impurities, and (iii) a bottom layer of anti-solvent and impurities and include the step of separating the solvent from said asphaltene-free raw material, the anti-solvent from said impurities.

4. The method according to claim 3 including the step of employing said separated solvent and anti-solvent in step (a).

5. The method according to claim 1 including the step of distilling said residues prior to step (a).

* * * * *